US009962742B2

(12) United States Patent
Schuetz

(10) Patent No.: US 9,962,742 B2
(45) Date of Patent: May 8, 2018

(54) PROCESS AND SYSTEM FOR MONITORING COMPONENTS IN AN ORE SCREENING INSTALLATION

(71) Applicant: Schenck Process Australia Pty Ltd, North Ryde (AU)

(72) Inventor: Martin Schuetz, Dieburg (DE)

(73) Assignee: SCHENECK PROCESS AUSTRALIA PTY LTD (AU)

( * ) Notice: Subject to any disclaimer, the term of this patent is extended or adjusted under 35 U.S.C. 154(b) by 0 days. days.

(21) Appl. No.: 15/105,052

(22) PCT Filed: Dec. 15, 2014

(86) PCT No.: PCT/AU2014/001125

§ 371 (c)(1),
(2) Date: Jun. 16, 2016

(87) PCT Pub. No.: WO2015/089548

PCT Pub. Date: Jun. 25, 2015

(65) Prior Publication Data

US 2016/0332199 A1 Nov. 17, 2016

(30) Foreign Application Priority Data

Dec. 16, 2013 (AU) ..... 2013904886

(51) Int. Cl.
*G08B 21/00* (2006.01)
*B07B 13/18* (2006.01)
(Continued)

(52) U.S. Cl.
CPC ..... *B07B 13/18* (2013.01); *B07B 1/4609* (2013.01); *G08B 21/18* (2013.01)

(58) Field of Classification Search
CPC ..... B07B 13/18; B07B 1/4609; G08B 21/18
(Continued)

(56) References Cited

U.S. PATENT DOCUMENTS

2004/0046698 A1* 3/2004 Martin ..... G06K 7/10178 343/700 MS
2005/0143956 A1* 6/2005 Long ..... G05B 19/4065 702/184

(Continued)

FOREIGN PATENT DOCUMENTS

WO 2002092245 11/2002
WO 2008122068 10/2008

(Continued)

OTHER PUBLICATIONS

Corresponding International Search Report for PCT/AU2014/001125 dated Feb. 17, 2015. WO.

*Primary Examiner* — Mark Rushing
(74) *Attorney, Agent, or Firm* — The Belles Group, P.C.

(57) ABSTRACT

A system for monitoring screening facilities which includes screening panels and components of the screen deck incorporating wirelessly readable identification tags; a computer database containing information relating to the screen deck components and their associated tags; a wireless tag detection station for regularly reading the conveyed material to detect tags; a computer program for matching the detected information with said data base and means for communicating a warning that a screen deck component has been dislodged.

9 Claims, 5 Drawing Sheets

(51) Int. Cl.
*B07B 1/46* (2006.01)
*G08B 21/18* (2006.01)

(58) Field of Classification Search
USPC ..... 340/539.1
See application file for complete search history.

(56) References Cited

U.S. PATENT DOCUMENTS

| | | | | |
|---|---|---|---|---|
| 2006/0096895 | A1* | 5/2006 | Reid-Robertson .... | B07B 1/4645 209/392 |
| 2006/0096985 | A1 | 5/2006 | Stolzman | |
| 2006/0108113 | A1 | 5/2006 | Scott et al. | |
| 2010/0193584 | A1 | 8/2010 | Getliff | |
| 2010/0231396 | A1 | 9/2010 | Tump | |
| 2010/0277319 | A1* | 11/2010 | Goidas ..... | H01Q 1/2216 340/572.1 |
| 2011/0095871 | A1* | 4/2011 | Kail ..... | G01V 15/00 340/10.6 |
| 2011/0285541 | A1 | 11/2011 | Freissle et al. | |
| 2014/0009303 | A1* | 1/2014 | Vasshus ..... | B01D 33/04 340/854.6 |

FOREIGN PATENT DOCUMENTS

| | | |
|---|---|---|
| WO | 2012128641 | 9/2012 |
| WO | 2014136121 | 9/2014 |

* cited by examiner

PROCESS AND SYSTEM FOR MONITORING COMPONENTS IN AN ORE SCREENING INSTALLATION

PRIORTY

Priority is claimed as a national stage application, under 35 U.S.C. § 371, to international patent application No. PCT/AU2014/001125, filed Dec. 15, 2014, which claims priority to Australian patent application 2013904886, filed Dec. 16, 2013. The disclosures of the aforementioned priority applications are incorporated herein by reference in their entirety.

This invention relates to improvements in ore screening in the separation and grading of materials in the mining and quarrying industries in particular this invention addresses the problem of contamination of the screened product stockpile with unscreened ore due to dislodged panels and/or detection of the loss of other screen media components.

BACKGROUND TO THE INVENTION

When a screening media panel is lost from the screening deck, contamination of the stockpile occurs (oversize in fines). Dislodged panels cannot be identified and this results in a costly contamination of the product fines stockpile if not identified in a timely manner Detection is also needed for screening media products, such as sideliners or panels, which are characterized by the absence of any steel reinforcement and thus cannot be detected by conventional metal detection methods. Australian patent 2002252827 discloses the provision of a data chip in a panel. It is intended to be used in association with a panel database that can be updated from time to time with wear history so that reports can be generated indicating which panels on a deck are nearing the time for replacement.

U.S. Pat. No. 6,997,325 discloses a system for detecting breaks in screens using RF signals. The signals can only pass through the screen if it is broken.

U.S. Pat. No. 7,143,007 discloses a computer system for managing replacement of components.

U.S. Pat. No. 7,484,625 which discloses a screening apparatus and drill rig with RFID tags in the components and a reading system in the main apparatus.

U.S. Pat. No. 8,330,610 discloses a system for detecting panel wear to a threshold level. The panel may include an RFID chip and a conductor coupled to the chip that is affected by wear.

None of these prior proposals adequately addresses the problem of ameliorating the consequences of dislodged screen deck components in down-stream operations.

It is an object of this invention to provide an effective means of monitoring screening decks and detecting dislodged components.

BRIEF DESCRIPTION OF THE INVENTION

To this end the present invention provides a method of monitoring screen deck components in a screening installation which includes a screen deck and a conveyor for screened material below said screen deck which includes the steps of a) incorporating wirelessly readable identification tags into components of the screen deck
b) optionally maintaining a computer database in relation to the screen deck components and their associated tags c) installing a wireless tag detection station adjacent said conveyor
d) regularly reading the conveyed material to detect tags on dislodged component
e) optionally matching the detected information with said data base
f) communicating a warning that a screen deck component has been dislodged.

A passive RFID chip is preferably incorporated in screening panels and components and a scanning unit is mounted around the conveyor belt mounted below the screen deck to identify the presence of any components that have become dislodged. The monitoring may be of the screen deck where persistent non reading of a particular tag would indicate dislodgement of its associated component or the monitoring may be focussed on the conveyor belt to detect a tag in the screened material on the conveyor which would indicate dislodgement of its associated component. Of course both the screen deck and the conveyor may be monitored.

By embedding RFID chips in screen media products, a solution is provided for detection of dislodged/failed screen media panels to prevent contamination of the stockpile with oversize material.

In addition, this invention provides a solution for detection of screen media containing no or small amounts of steel material or panels with plastic reinforcing frames. The desired solution minimizes the impact on panel manufacturing to incorporate sensors within the screen media panel to achieve the above object. Embedding an RFID tag into a screen media panel may be accomplished without affecting the production process or compromising the normal panel screening functionality.

In another aspect this invention provides a system for monitoring screening facilities which includes a) screening panels and components of the screen deck incorporating wirelessly readable identification tags
b) an optional computer database containing information relating to the screen deck components and their associated tags
c) a wireless tag detection station for regularly reading the conveyed material to detect tags
d) an optional computer program for matching the detected information with said data base
e) means for communicating a warning that a screen deck component has been dislodged.

The screening panel may be any conventional panel made by casting, injection moulding of elastomeric or vulcanised elastomeric material, preferably polyurethane or rubber, which has embedded within it reinforcing bars which define the outer edges of the panel to provide support to the screening surface. The reinforcing may be of plastic or metal. Steel has conventionally been used, but fibre reinforced plastics are preferred because of their lighter weight and resistance to corrosion. It is preferred to incorporate at least one tag on the reinforcing frame of the panel. This invention is applicable to any modular screening panel including those of the type described in patent specifications U.S. Pat. Nos. 482,212, 517,319, 644,293. The method of manufacturing the panels according to this invention is the same as for conventional panels as outlined in the above mentioned patents. In addition other plastic screen deck components such as side bars and sideliners and hold down bars may also incorporate readable tags.

It is within the scope of this invention to monitor the tags on the screening deck. Communication of data stored on chip such as wear levels, age of panel to an evaluation database. Preferably the data is synchronised with other data captured on a database such as manufacturing data, panel type, etc. as per Australian patent 2002252827. For example the data may be used for online prediction of change-out or to report on trial panels that may require to be changed out more frequently. The service team may simply replace panels and the system may automatically recognize the change and update the information on the database. This information may be sent to a central database for evaluation and reporting purposes. In this way a historical data may be stored and accessed on the database to enable identification of previous detection events.

DETAILED DESCRIPTION OF THE INVENTION

A preferred form of the invention will now be described with reference to the drawings in which.

Figure 1:
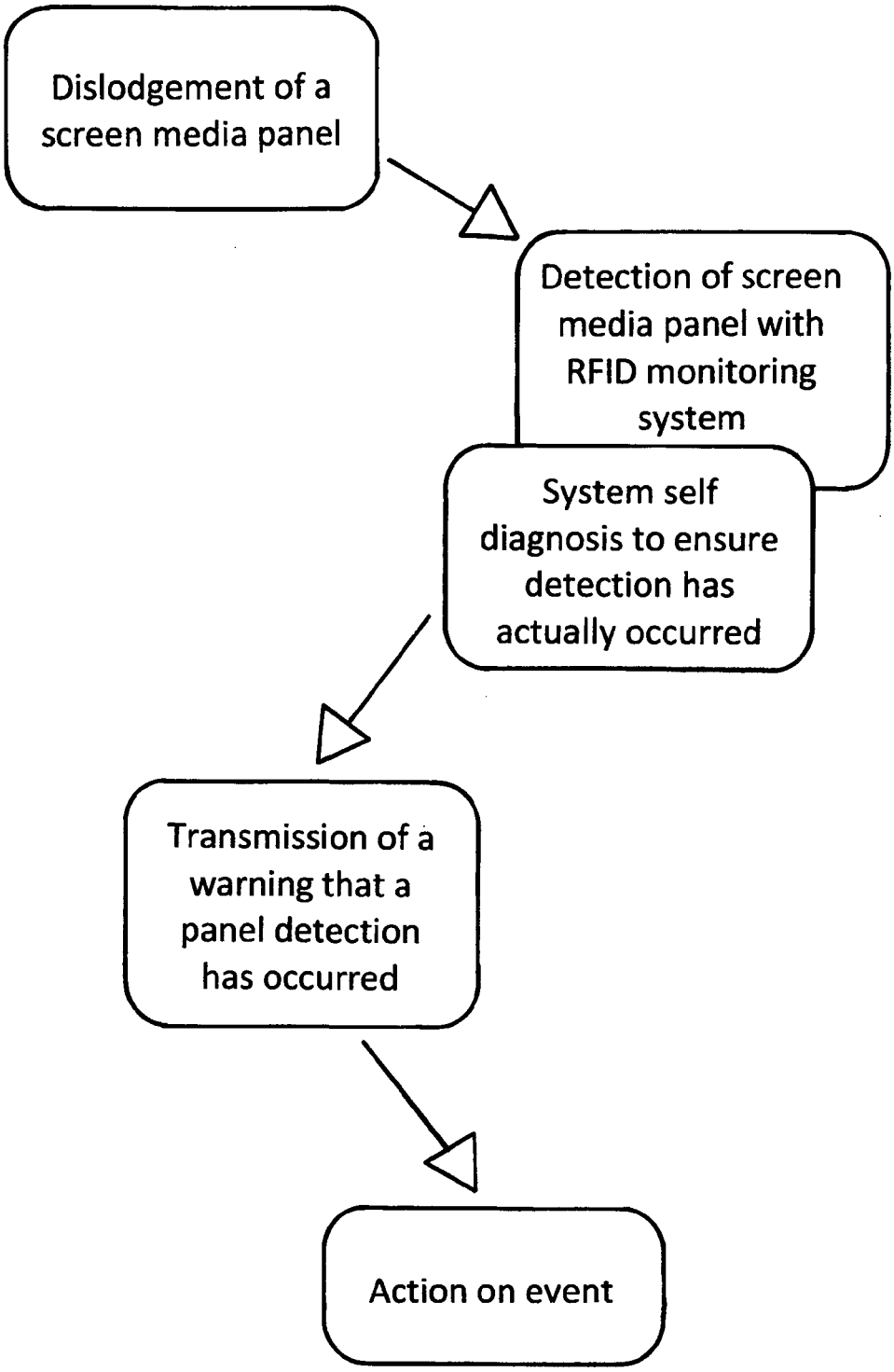
FIG. 1 depicts a flow diagram of the method of this invention.
Figure 2:
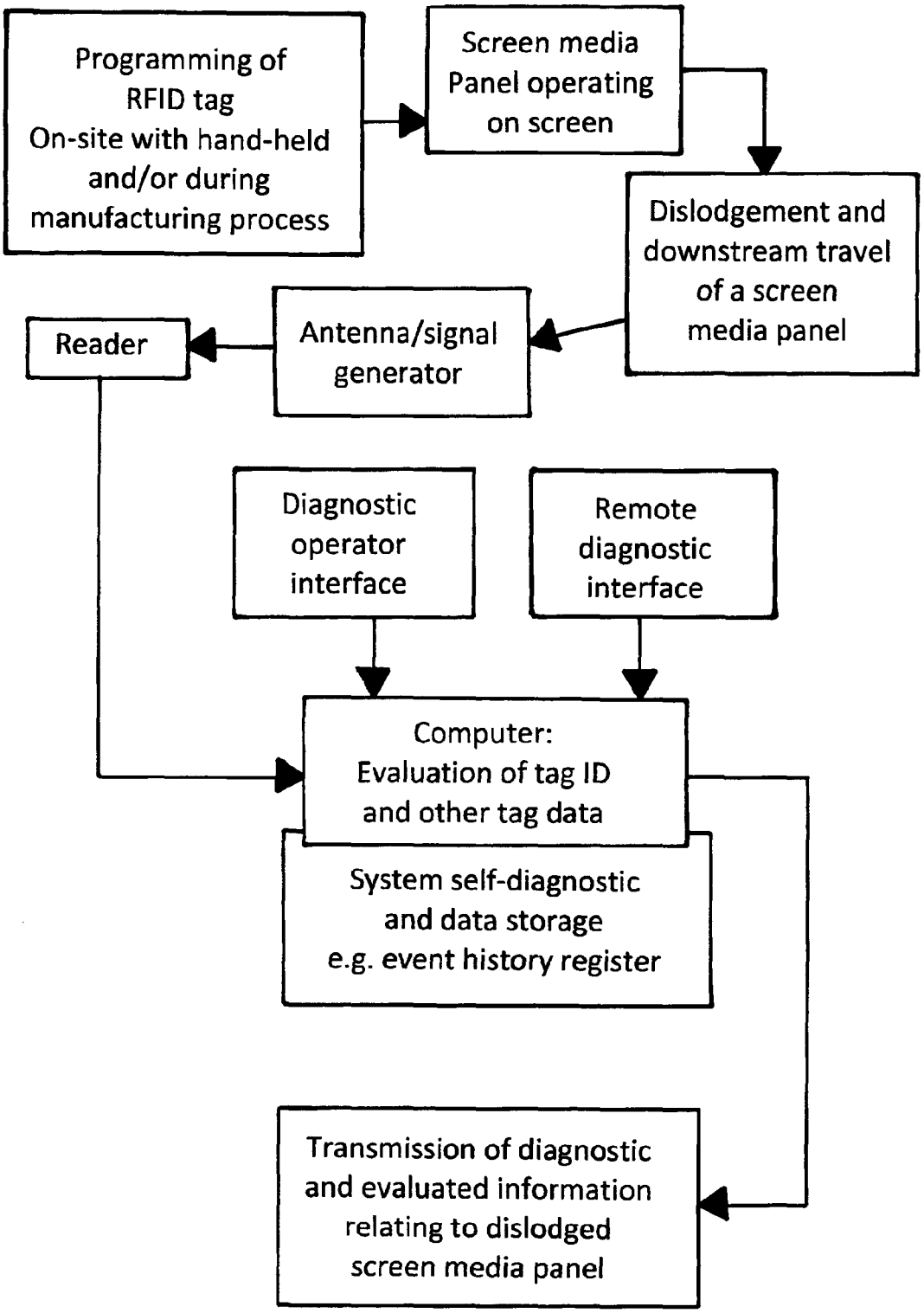
FIG. 2 depicts schematically the system of this invention.
Figure 3:
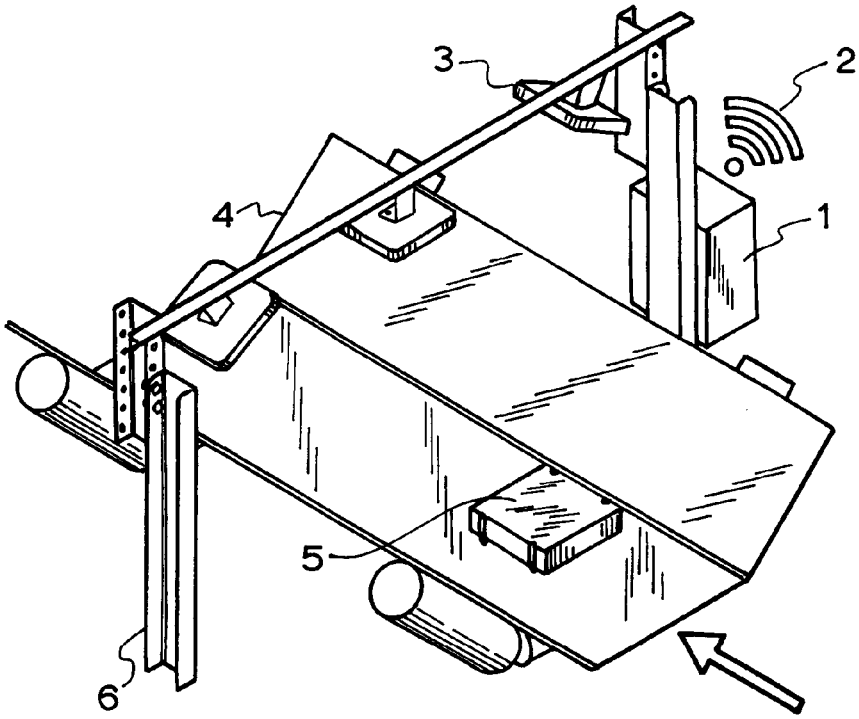
FIG. 3 depicts a reader station in accordance with this invention.

Low cost UHF passive RFID technology is incorporated in the screen media panel and is monitored with a close to real-time monitoring with a fixed reading gate strategically positioned over a conveyer belt section as shown in FIG. 3.

The fixed monitoring unit is preferably designed to be mounted around an available conveyer belt 4. A configuration of antennas 3 is used to optimize detectability and monitor the target application covering the complete conveying system.

The monitoring unit consists of antennas 3 to power/read RFID tags, one or more readers in enclosure 1 with a computer such as a PC or microcontroller or electronic control unit ECU which are mounted to a simple support structure 6. The monitoring unit 1 is customized for attachment to the conveyer belt support structure and enclosed for outside use. The system may be hard wired to transmit, or may wirelessly transmit, detection and diagnostic signals 2 to a third party monitoring system e.g. PLC or indication light.

Optionally the system may be configured for remote access (WiFi, 3G, etc.) The main components in the enclosure 1 are an embedded PC; UHF Gen 2RFID reader (Impinj Speedway Revolution 4 port); Power Supply; and an optional air conditioner for hot environments.

The monitoring unit also includes an appropriate number of long range passive RFID UHF circular polarized antennas 3 to monitor the desired span; antenna cables and electrical connections; and mounting structures.

The screening panels 5 incorporate RFID tags 7: for example Confidex Carrier M4QT (long range UHF)

Upon detection of a panel the monitoring unit 1 submits a signal to a connected PLC or optical device such as a flashlight.

The monitoring system preferably, includes a program for self-diagnoses of all electronic equipment and a functional related diagnostics to ensure the availability of the system. The diagnostics may include history and usage registers and may be accessed remotely.

Figure 4:
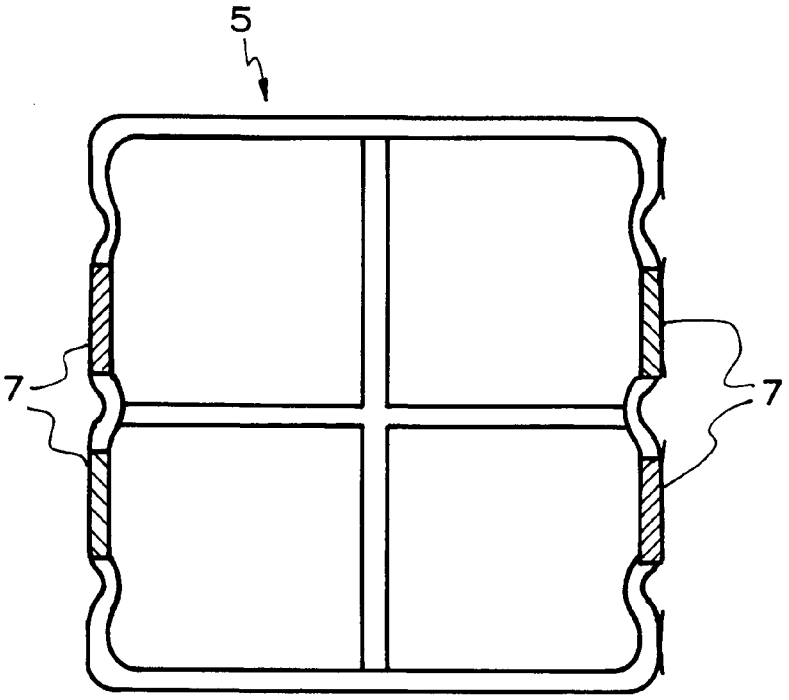
FIG. 4 depicts a reinforcing frame used in this invention.
Figure 5:
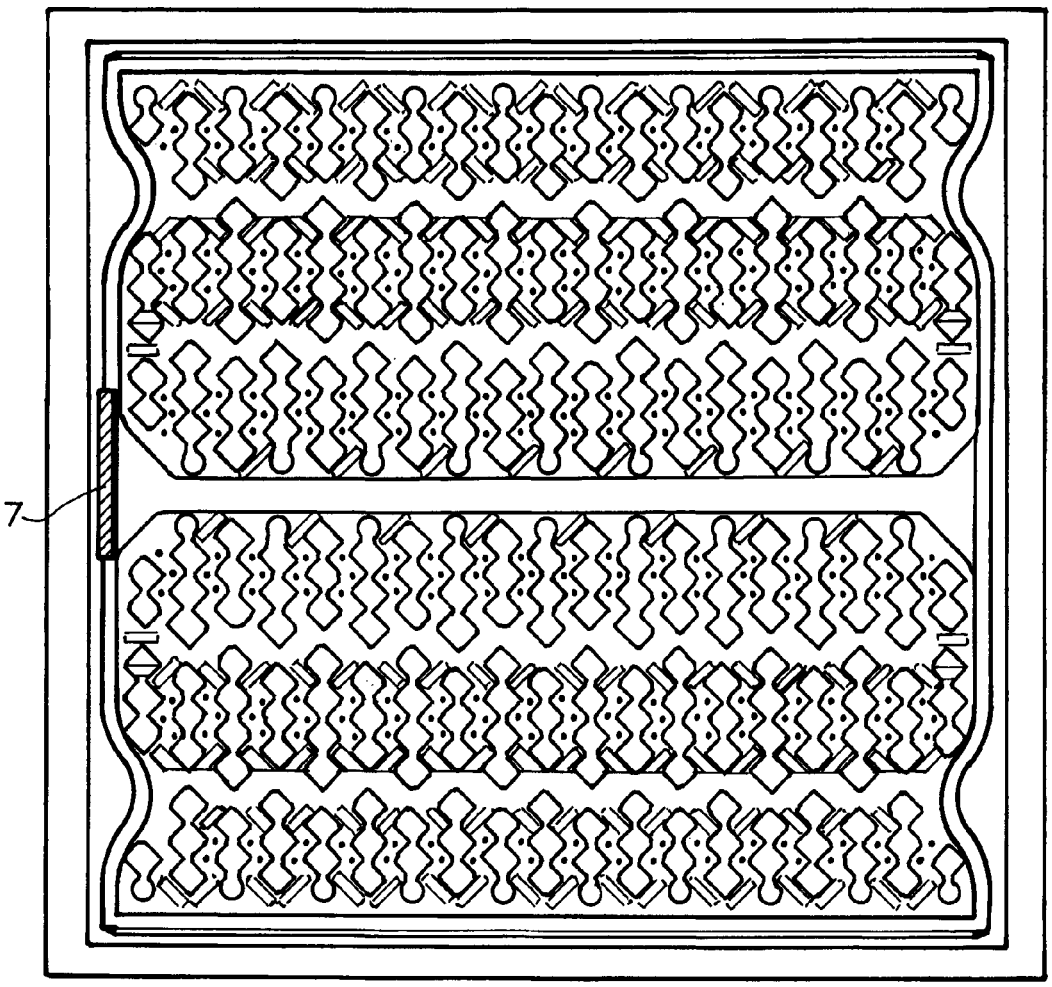
FIG. 5 depicts a screening panel according to this invention.

The preferred location for the RFID tags 7 is on the reinforcing frame of the screening panel as shown in FIGS. 4 and 5. The tag 7 is preferably attached or embedded in the reinforcing frame or can be located anywhere within the panel as appropriate. Furthermore the reinforcement frame may incorporate a provision to attach the RFID chip The RFID tags and position of embedment in the panel or other components are preferabily chosen to suit the following requirements

- High temperature tolerance suitable to survive the panel manufacturing process temperatures
- Able to endure the full operational life of a screen media panel on a vibrating screen (high cyclic and impact loading)
- Dimensioned to suit attachment to the metallic screen module frame, preferably in a low stress region along the fixing side of the screen media panel.
- Selection of a tag with a large antenna for a higher read range and detection rate
- Tuned for on-metal performance (in the case of steel reinforcing frames)
- Wide bandwidth which allows for tuned performance when attached various metallic geometries RFID "on-metal" tags are specifically tuned to be coupled to metallic surfaces. The RFID tag may be on metal, active, semi-active, passive or operate at any other frequency (e.g. HF etc.) or wireless communication technology e.g. Bluetooth, Wireless LAN, etc.

Alternatively the tag may be embedded post manufacture of the panel i.e. by attachment to a relief in the panel which may or may not be plugged for protection of the RFID chip. This is especially important for panel manufacture at high and long sustaining temperatures (>150 degC) such as for rubber injection moulded panels The monitoring setup must cope with typical operating conditions of belt conveying systems in mining environments:

Detection speed: Typical belt speeds: 5.25 m/s

Reading distance: Typical belt Width: 1600 mm or additional antennas can compensate for greater widths RFID tag readability assuming that the screen media panel may be buried underneath (moist) iron ore:

Iron ore with moisture content typically 10%

Conveyer belt material bed depths of typically 300 mm.

Figure 6:
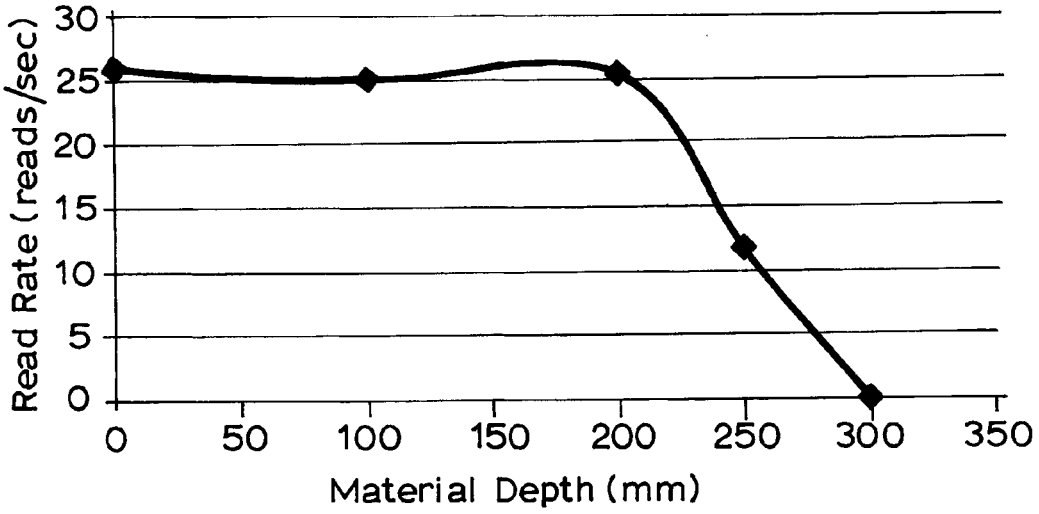
FIG. 6 is a graph plotting read rate against depth of material for high moisture content.
Figure 7:
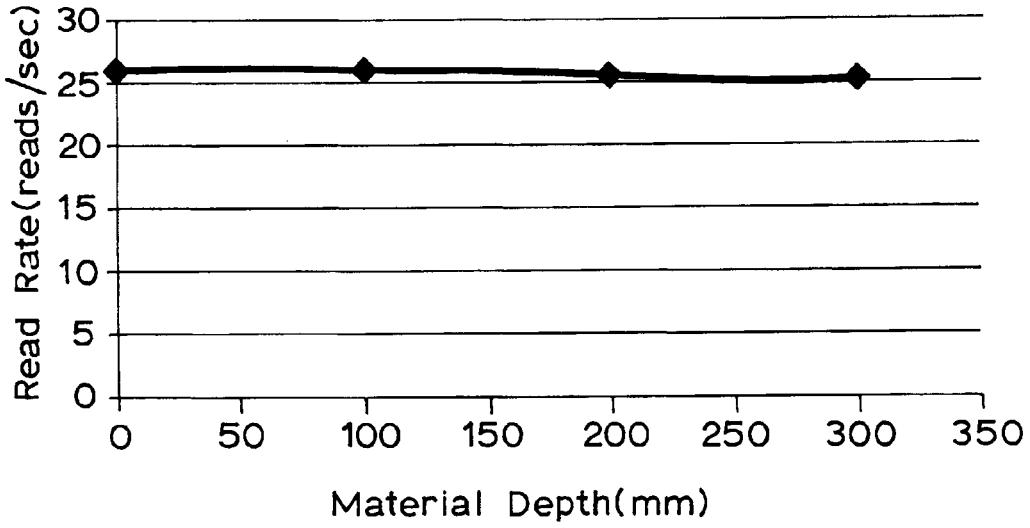
FIG. 7 is a graph plotting read rate against depth of material for low moisture content.

The RFID tag (panel) orientation on the conveyer belt is uncontrolled and heavily influences the readability depending on the effective read angle to the antenna Environmental influences e.g. rain, free water or surrounding (steel) structures that impede read performance Typical influence on the readability of a passive RFID chip of an interfering material bed for moist ore is shown in FIGS. 6 and 7.

An alternative or additional detection system is to deploy an array of antennas preferably encapsulated in polyurethane and positioned behind the screen protective sideliners or incorporated directly into the sideliners monitoring the full or specific portions of the screen deck and continuously reading all tagged m panels. Loss of a panel as it fell through the supporting screen frame is indicated by the persistent non reading of a given RFID tag. In addition any data stored on the RFID chip could be read continuously, thus providing online current information of the screen deck for each individual screen media panel. In addition information relating to the wear level of the panel and components may be sensed and transmitted.

Other monitoring positions are possible as it may be desirable to detect a failed panel on any point in a downstream process without compromising the general solution: Such as chutes, re-claimers, discharge end of a vibrating screen, etc.

It is also within the scope of this invention to incorporate more than one RFID tag preferably diagonally across the panel, compensating for reduced readability due the unknown orientation of the panel to the antenna structure on the conveyer belt.

In general and without limitation this RFID technology may be incorporated into other media products such as Side liners
HDB rails
Spray-nozzles
Rubber linings
Wedge wire screening media
Non-screening media replacement parts and other consumables The RFID chip may be prepared to store data that may be read by the monitoring unit or the data may be stored on the evaluation computer or external database and clearly be identified by reading the RFID tag identifier information. This data may be used to identify the source of failure, e.g. screen, deck, or specific panel and position on the screen deck. This information may be evaluated on the evaluation computer and be used to transmit further data relating to the detected dislodged panel or to shut down the screening operation to prevent further stockpile contamination.

From the above it can be seen that the present invention a monitoring system for screening installations to ameliorate the problems caused by dislodged screen deck components.

Those skilled in the art will be aware that this invention may be implemented in embodiments other than those described without departing from the core teachings of this invention.

The claims defining the invention:

1. A method of monitoring components in a screening installation which includes a conveyor for screened material, the method comprising:

a) incorporating wirelessly readable identification tags into the monitored components;
b) maintaining a computer database in relation to the monitored components and their associated tags;
c) installing a wireless tag detection station adjacent or around said conveyor, said station comprising an array of passive RFID antennas, positioned to monitor an entire width of the conveyor;
d) regularly reading the conveyed material to detect tags on one or more of the monitored components which has become accidentally dislodged, and matching the detected information with said database to identify a respective installed position of the one or more dislodged monitored components within the screening installation;
e) communicating a warning that the one or more of the monitored components has been dislodged.

2. The method as claimed in claim 1 in which tag detection and warning communication occur in real time.

3. A system for monitoring screening facilities which includes:

a) a plurality of monitored components incorporating wirelessly readable identification tags;
b) a computer database in relation to the monitored components and their associated tags;
c) a wireless tag detection station for regularly reading material on a conveyor to detect the identification tags, said station comprising an array of passive RFID antennas positioned to monitor an entire width of the conveyor;
d) a computer program for matching the detected information with said database when one or more of the monitored components has become accidentally dislodged, the computer program configured to identify a respective installed position of the one or more dislodged monitored components within the screening facilities; and
e) means for communicating a warning that one or more of the monitored components has been dislodged.

4. The system as claimed in claim 3 in which tag detection and warning communication occur in real time.

5. The method as claimed in claim 1 in which the monitored components comprise one or more screening panels, and at least two wirelessly readable identification tags are incorporated diagonally spaced apart in each screening panel.

6. The system as claimed in claim 4 in which the monitored components comprise one or more screening panels, and at least two wirelessly readable identification tags are incorporated diagonally spaced apart in each screening panel.

7. A method of monitoring components in a screening installation which includes a conveyor for screened material, each monitored component having a predetermined position with respect to the conveyor, the method comprising:

a) incorporating wirelessly readable identification tags into the monitored components;
b) maintaining a computer database in relation to the monitored components and their associated tags;
c) monitoring the identification tags with a wireless tag detection station comprising an array of passive RFID antennas positioned to monitor an entire width of the conveyor and the predetermined position of each monitored component;
d) determining whether one or more of the monitored components has become accidentally dislodged by detecting at least one of a presence of identification tags on the conveyor and an absence of identification tags from the predetermined positions, and determining which of the monitored components is dislodged by reference to said database to identify a respective installed position of the one or more dislodged monitored components within the screening installation;
e) communicating a warning that the one or more of the monitored components has been dislodged.

8. The system as claimed in claim 7 in which the monitored components comprise one or more screening panels, and at least two wirelessly readable identification tags are incorporated diagonally spaced apart in each screening panel.

9. The method as claimed in claim 7 in which tag detection and warning communication occur in real time.

* * * * *